US007021428B2

(12) United States Patent
Han et al.

(10) Patent No.: US 7,021,428 B2
(45) Date of Patent: Apr. 4, 2006

(54) ELEVATOR FLOOR CALL PANEL HAVING DUAL OPERATING MODES

(75) Inventors: Lin Han, Beijing (CN); Paul Friedli, Remetschwil (CH)

(73) Assignee: Inventio AG, Hergiswil NW (CH)

( * ) Notice: Subject to any disclaimer, the term of this patent is extended or adjusted under 35 U.S.C. 154(b) by 67 days.

(21) Appl. No.: 10/325,360

(22) Filed: Dec. 19, 2002

(65) Prior Publication Data

US 2003/0111299 A1 Jun. 19, 2003

(30) Foreign Application Priority Data

Dec. 19, 2001 (EP) ..... 01811242

(51) Int. Cl.
*B66B 1/34* (2006.01)

(52) U.S. Cl. ..... 187/395; 187/396; 187/901; 187/391

(58) Field of Classification Search ..... 187/380, 187/384, 413, 901, 247, 297, 391–398
See application file for complete search history.

(56) References Cited

U.S. PATENT DOCUMENTS 4,718,520 A 1/1988 Schroder
5,679,933 A 10/1997 Weber et al.
5,679,934 A * 10/1997 Juntunen et al. ..... 187/395
5,975,247 A 11/1999 Choi
6,105,729 A * 8/2000 Nakamori et al. ..... 187/391
6,161,654 A * 12/2000 Sirigu et al. ..... 187/391
6,161,655 A * 12/2000 Lejon et al. ..... 187/392
6,315,083 B1 * 11/2001 Schuster et al. ..... 187/391
6,326,934 B1 * 12/2001 Kinzie ..... 345/1.1
6,502,668 B1 * 1/2003 Chida et al. ..... 187/395
6,508,334 B1 * 1/2003 Matsuda et al. ..... 187/391
6,550,586 B1 * 4/2003 Takeuchi ..... 187/391
6,550,587 B1 * 4/2003 Yuasa et al. ..... 187/394
2001/0035314 A1 * 11/2001 Yoshida et al. ..... 187/382

FOREIGN PATENT DOCUMENTS

GB 2241090 A * 11/1990 ..... 187/391
JP 01288584 11/1989

* cited by examiner

*Primary Examiner*—Jonathan Salata
(74) *Attorney, Agent, or Firm*—Butzel Long

(57) ABSTRACT

A panel for an elevator installation has a predetermined number of floor buttons for generating hall calls or car call commands wherein a single floor button or a floor button combination is provided for each floor. The panel can be converted by a converter button or a sensor so that all floors are also selectable by a decade keyboard formed by a portion of all the floor buttons. All floors are thus selectable comfortably and without restriction even by handicapped persons.

20 Claims, 5 Drawing Sheets

Detail A

ELEVATOR FLOOR CALL PANEL HAVING DUAL OPERATING MODES

BACKGROUND OF THE INVENTION

The present invention relates generally to a call panel for an elevator installation and a method of controlling the panel to provide different functions for a button or key on the panel.

There is shown in the U.S. Pat. No. 5,975,247 an elevator panel which has different buttons for the input of a floor call. The buttons are distributed over the entire area of the panel. The buttons for the upper floors are arranged higher than the buttons for the lower floors. A passenger who wants to travel to the floor 60, for example, has to actuate a button arranged higher on the panel than if the passenger wanted to travel to a lower numbered floor. This process will be difficult for a handicapped person with a wheelchair, since these higher numbered floor buttons are placed too high. This panel is not suitable for handicapped persons.

The present invention has the object of proposing a panel and a method of controlling the panel which do not have the aforesaid disadvantages and which enable problem-free operation of the panel for all passengers.

SUMMARY OF THE INVENTION

The present invention concerns a panel apparatus for generating floor calls in an elevator installation comprising: a panel having a front face and adapted to be mounted on one of an elevator car wall and a building hallway wall; a predetermined number of floor buttons mounted on said panel front face, said floor buttons being actuatable either individually or in combination for generating a floor call for travel to an associated destination floor for each destination floor in a normal mode of operation of the panel apparatus; and a converter means mounted on said panel front face and being actuatable for converting the panel apparatus from said normal mode of operation to a converted mode of operation whereby all of the destination floors are also selectable by actuation of a group of said floor buttons being less than all of said floor buttons.

The present invention also concerns a method of operating a panel apparatus in a elevator installation comprising the steps of: a) providing a predetermined number of floor buttons; b) actuating the floor buttons individually or in combination in a normal mode of operation to generate floor calls to associated ones of all destination floors of a building served by an elevator installation; c) providing converter means; d) actuating the converter means to switch from the normal mode of operation to a converted mode of operation; and e) actuating a group of the floor buttons being less than all of the floor buttons in the converted mode of operation to generate the floor calls for all of the destination floors.

An advantage is to be seen in the fact that, with a single panel, all elevator passengers can place all possible commands comfortably and without limitation. The panel can be operated not only in conventional manner, but also with a portion of the floor buttons. A special keyboard for handicapped persons is not needed. The structure of the inner side of the car does not have to be changed. The costs of the elevator installation are reduced.

In a preferred embodiment, a selected number of the floor buttons forms a decade keyboard. A wide selection of commands is thereby made available with the help of the numerals "0" to "9".

In a further embodiment the panel has a converter button producing the signal. This has the advantage that the converting over of the panel can be carried out manually by direct contact.

In a further embodiment the panel has a sensor producing the signal. This allows automatic conversion of the panel without direct contact.

Moreover, the panel according to the present invention also has the following advantages:

With a small amount of restructuring of an already installed panel, an old panel can also take over the functions according to the present invention. This means that the teaching according to the present invention can find use not only on an old, already installed panel, but also on a new panel to be installed.

Not only can all commands of the standard panel now be placed by the decade keyboard, but also additional commands or functions can be generated. All explained features are usable not only in the respectively indicated combination, but also in other combinations or by themselves without departing from the scope of the present invention.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
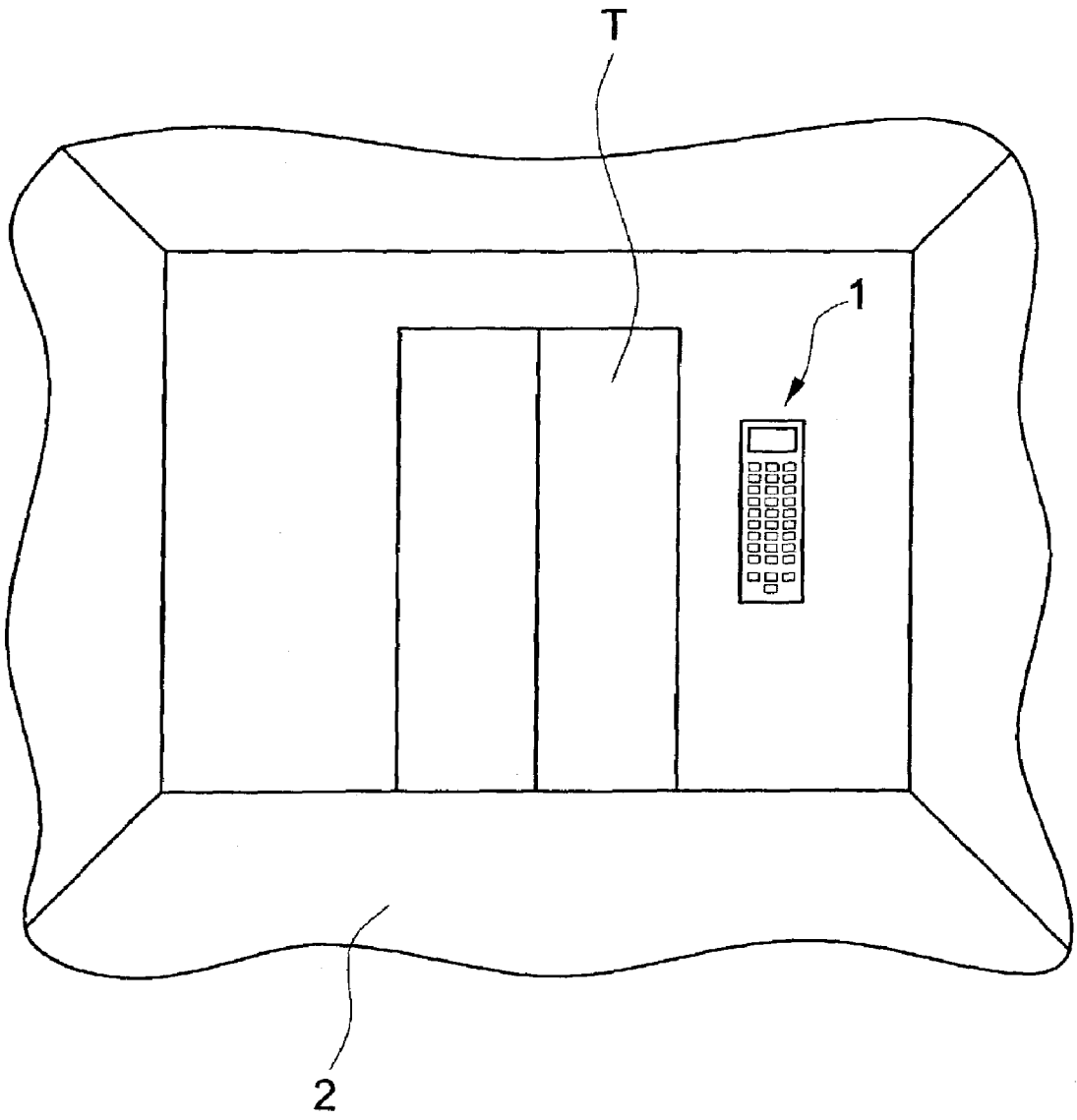
FIG. 1 is a fragmentary view of the inside of an elevator car with a call panel according to the present invention.

FIG. 1 shows the inside of an elevator car 2 that has mounted on the wall, near an elevator door T, a panel 1 for the input of elevator commands. This panel is an entirely normal, standard panel which is operable in a normal mode of operation on the basis of all buttons which are present for entering car calls representing travel commands by passengers to destination floors. The panel 1 also can be located on a hallway wall at a floor of a building for entering hall calls representing travel commands by passengers to destination floors. Herein, the car calls and the hall calls will be designated as "floor calls".

Figure 2:
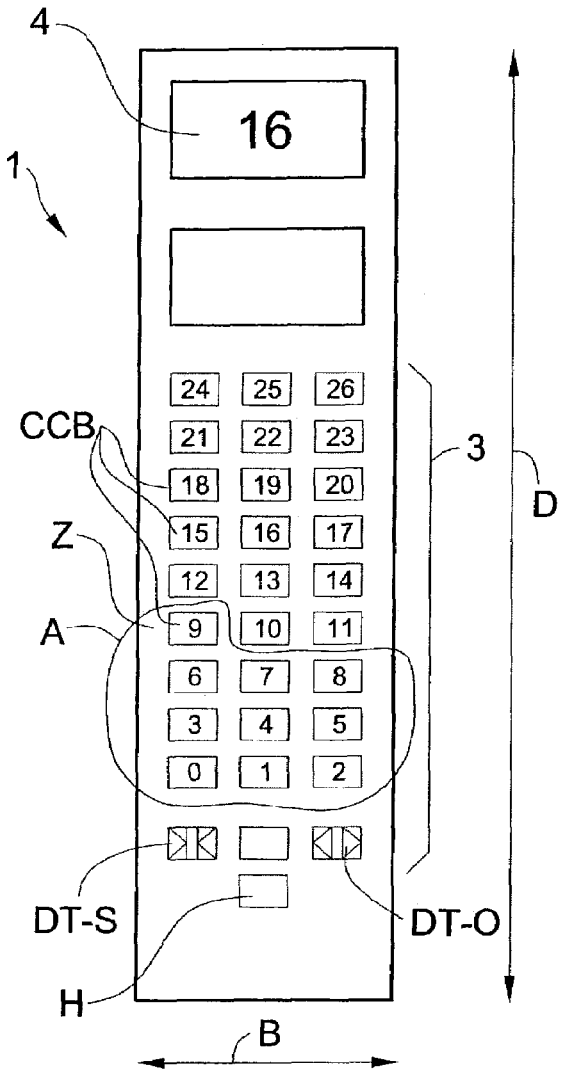
FIG. 2 is an enlarged elevation view of the panel shown in FIG. 1 according to a first embodiment of the present invention.

One embodiment of the panel 1 is illustrated in more detail in FIG. 2. The panel 1 extends in vertical direction, i.e. a width B that is smaller than a height D, and has several buttons 3 arranged on a lower portion of a front face of the panel 1 and a display device 4 positioned on an upper portion. The buttons 3 include a door opening button DT-O and a door closing button DT-S, as well as floor buttons or car call buttons CCB, wherein a floor button CCB is provided for each floor. In this example, twenty-seven floor buttons CCB are shown, the actuation of which allows servicing of the floors "0" to "26". Obviously the panel 1 can have more or less floor buttons CCB. The floor buttons CCB are continuously numbered from the bottom to the top, which means that the floor buttons for the higher floors are arranged higher on the panel 1 than the floor buttons for the lower floors. In this example, the floor buttons CCB are distributed in three columns. The panel 1 further includes a converter button H that is arranged below the buttons 3. The actuation of the converter button H allows all possible commands that normally can be placed by the standard panel 1 to be placed with only a portion of all of the floor buttons CCB present on of the panel 1. In one embodiment, the panel 1 is converted over to a converted mode of operation by the actuation (pressing) of the converter button H to a decade keyboard Z. This means that the floor buttons CCB numbered "0" to "9" of the panel 1 are used as the decade keyboard Z, by means of which, for example, all floors can be selected to generate floor calls. This means that even the higher floors are selectable by means of the decade keyboard Z.

This converted mode or method of operation of the panel 1 has the advantage that even a handicapped person seated on a wheelchair can select the higher floors without problems. This is possible because the decade keyboard Z is at a height which can be easily reached even by seated persons. All floors are thus selectable by everyone without limitation. A special keyboard or additional devices for handicapped persons are not needed.

Figure 3:
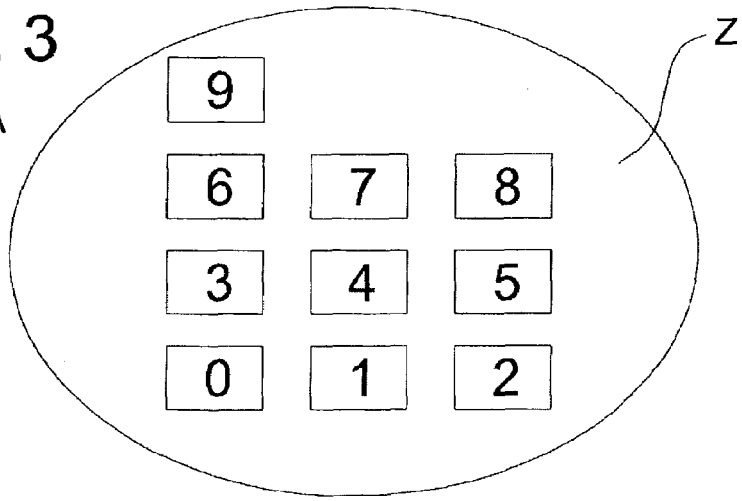
FIG. 3 is an enlarged view of a portion of the panel shown in FIG. 2 that is operable as a decade keyboard.

A detail area A in FIG. 2 is illustrated in enlarged form in FIG. 3. The floor buttons CCB numbered "0" to "9" form the decade keyboard Z. On actuation of the converter button H of the panel 1 the decade keyboard Z is activated. Constant illumination or flashing of the floor buttons "0" to "9" confirms activation of the decade keyboard Z. The floor buttons "0" to "9" can preferably also be provided with Braille characters so that they can be identified by blind persons.

After the converter button H is actuated, the floor "16", for example, can be selected by successive actuation of the floor buttons "1" and "6". At the same time this selection is preferably confirmed by automatic illumination of the corresponding floor button CCB, in our example the floor button "16". A tone confirms the actuation of any one of the buttons 3.

Figure 4:
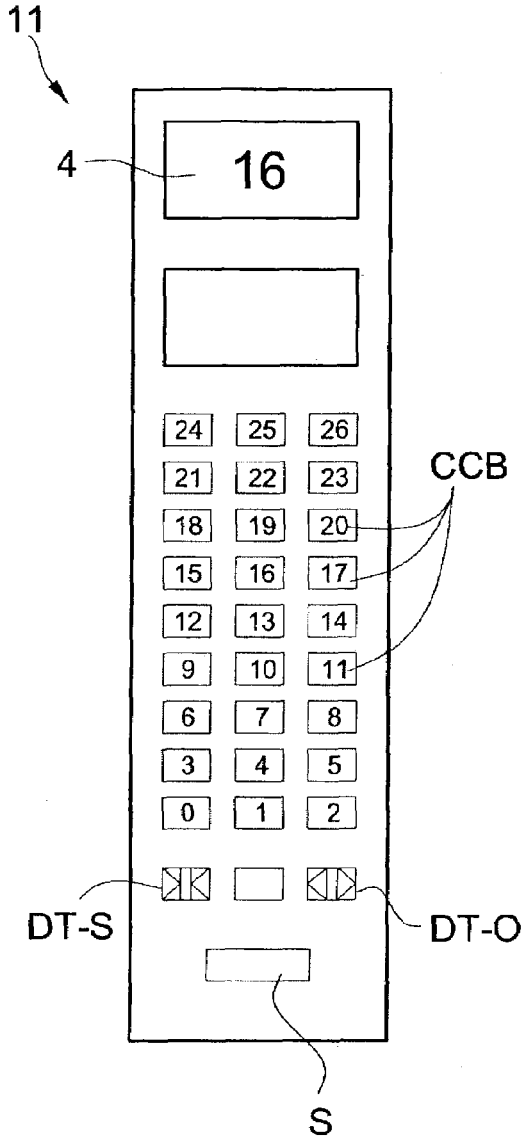
FIG. 4 is a view similar to FIG. 2 showing the panel according to a second embodiment of the present invention.

FIG. 4 shows a further or second embodiment panel 11 wherein basically the same panel 1 as in FIG. 1 is illustrated with the converter button H replaced by a sensor S. The conversion function here is not actuated by a converter button H, but with the help of the sensor S which detects a signal and for its part transmits a further signal to a control device of the panel 11. This means that the decade keyboard Z can also be activated without direct contact of the panel 11, for example at a local spacing therefrom. Through the sensor S, for example, a specific handicapped person can be identified and an automatic conversion to the decade keyboard Z carried out. The identification can take place, for example, with the help of a transmitter (not shown) carried by the handicapped person. This can happen, for example, in accordance with the transponder principle. The user carries, for example, a chip card with an identification code which is detected by the sensor S as a signal. The sensor S can be arranged anywhere on the panel 11. It is important that the sensor S is located where all passengers in the car 2 or in the corridor can be detected by it. The arrangement of the sensor S on the lower portion of the panel 11 is a preferred variant.

The decade keyboard Z remains activated until one of the following situations occurs:

The door closing switch DT-S is actuated; or

The decade keyboard Z remains unactuated for more than a predetermined time, for example 5 seconds.

If the decade keyboard Z is no longer activated, then the buttons "0" to "9" are no longer lit or no longer flash. The panel 1 (or 11) can then be operated again in the usual manner.

Figure 5:
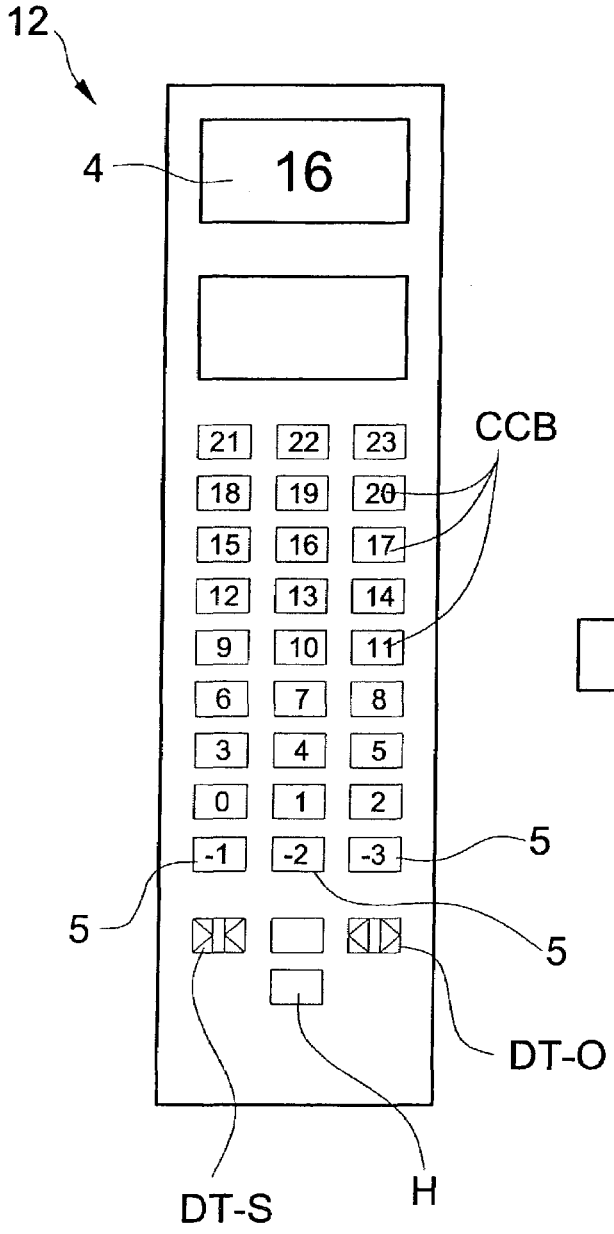
FIG. 5 is a view similar to FIG. 2 showing the panel according to a third embodiment of the present invention.

FIG. 5 shows a further variant or third embodiment panel 12 according to the invention, which is usable for buildings with basements. The panel 12 has three minus buttons 5 that are arranged below the floor buttons CCB for the upper floors. The minus buttons 5 are therefore mounted at a height which is also easily reachable even by seated handicapped persons. Preferably the three minus buttons 5 lie above the door closing button DT-S, the door opening button DT-O and the converter button H. The basements can thus be selected by actuation of one of the minus buttons 5 and, in a given case, one of the buttons "0" to "9" without the converter button H having to be actuated. The converter button H is only actuated in order to select higher floors, for example floor "16" with the help of the floor buttons "0" to "9", i.e. with the decade keyboard Z.

The decade keyboard Z can also be used for other functions. In certain buildings, access to certain floors is possible only for authorized persons. In order to give access to these specific floors the authorized person must firstly be identified by the elevator. This can take place, for example, through input of a code "RC". A portion of the floor buttons CCB of the panel 1 (11, 12), for example the above-mentioned decade keyboard Z, can be used for this purpose. The authorized person initially has to convert the panel to the decade keyboard Z by the converter button H, then input the code "RC" via the decade keyboard Z and finally select the floor by the decade keyboard Z or by direct actuation of the corresponding floor button CCB. Subsequently, the door closing button DT-S can be actuated, which can also serve as an input button ("enter" button). An acoustic signal confirms input of the correct code "RC". An incorrect code "RC" is ascertained by suitable software and automatically converts the decade keyboard Z back to the conventional panel 1 (11, 12). Without input of the code "RC", specific floors cannot be serviced by direct actuation of the corresponding floor buttons CCB.

In similar manner the elevator can be booked with special functions by input of further codes "SFC". For example, there can be input via the decade keyboard Z in each instance a further code "SFC" for reservation of the elevator with or without parking, for switching on and controlling the light or a ventilator of the elevator car, for special journeys, etc. The acknowledgement that the control of the elevator has registered a special function is carried out by a temporary indication, for example of a letter on the display device 4 of the panel 1 (11, 12).

Due to the presence of the panel 1 (12) with the converter button H according to the invention no special buttons or keys in the elevator car or in the corridor are therefore necessary, everything being able to be undertaken via the panel 1 (12). The same is true for the panel 11 with the sensor S.

Figure 6:
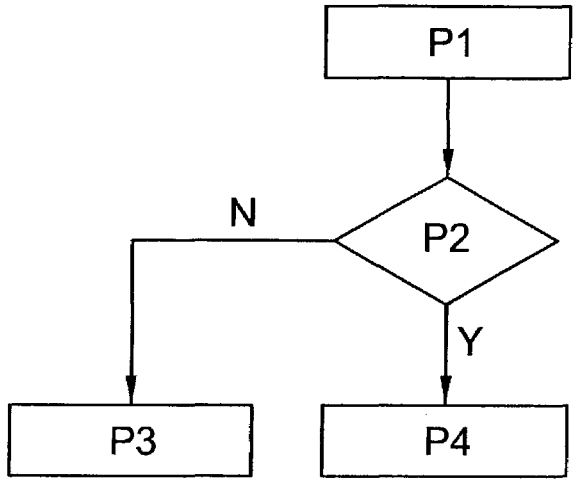
FIGS. 6, 7 and 8 are flow charts of a method of operating a panel according to the present invention.
Figure 7:
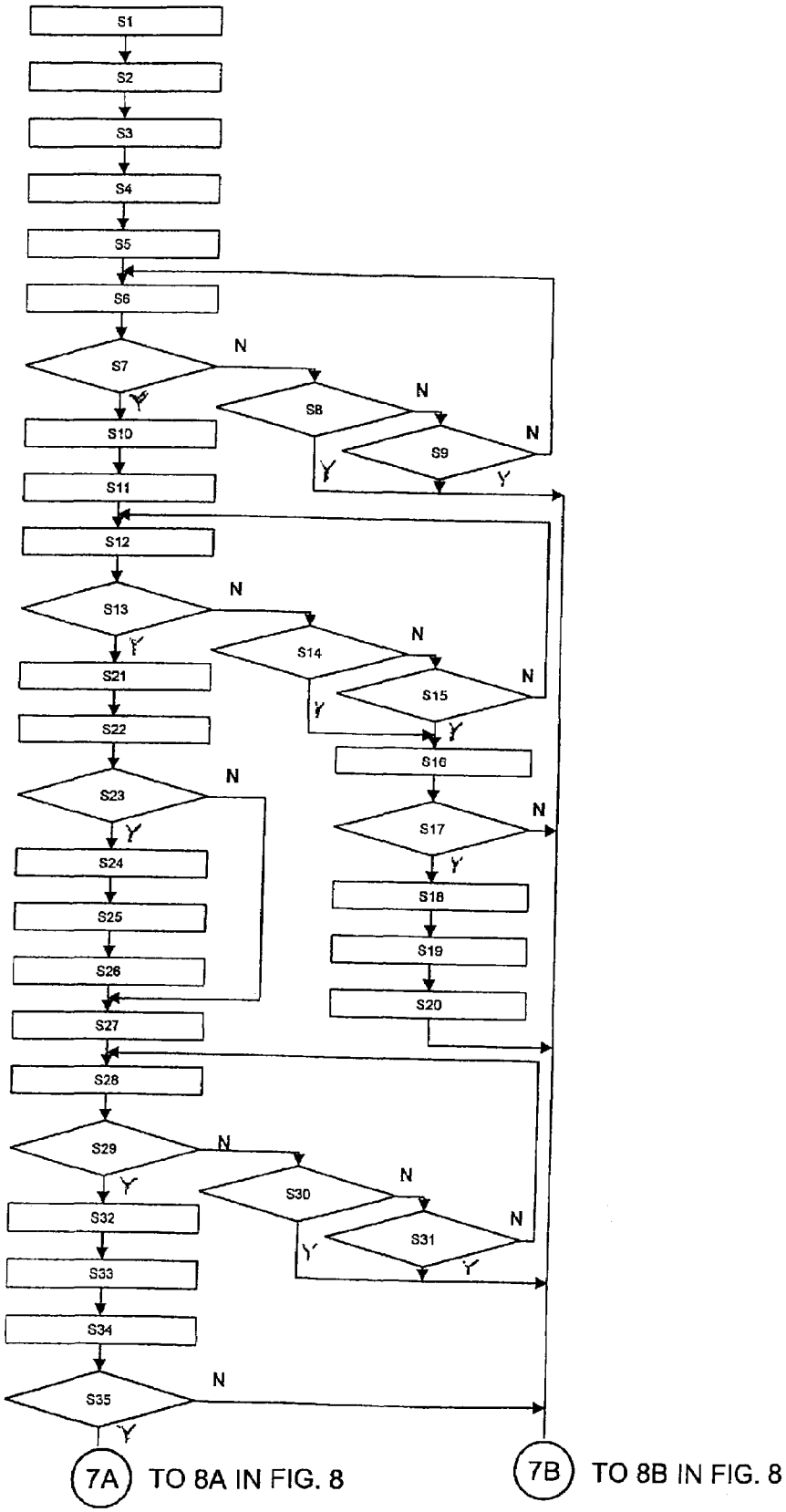
Figure 8:
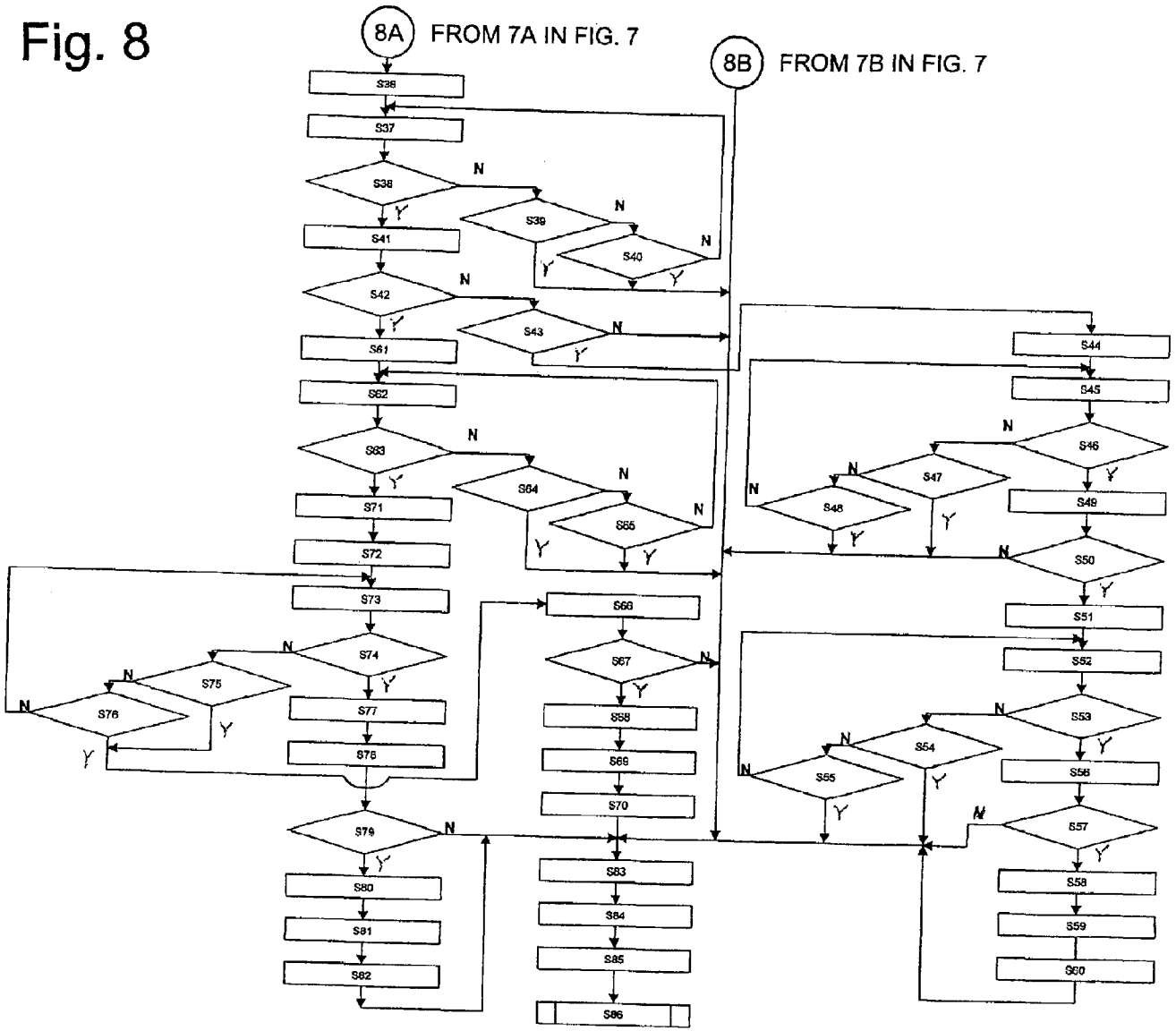

FIGS. 6, 7 and 8 show flow charts of the operating method of the panel according to the present invention.

FIG. 6 shows a main flow chart of the function of the panel 1 (11, 12). The method starts by checking the status (step P1) of the converter button H (sensor S). If the converter button H (or sensor S) is actuated (step P2), then the method branches at "Y" and the decade keyboard Z is switched on (step P4). Without actuation of the converter button H, the method branches at "N" and the panel 1 (11, 12) is used in a conventional manner as a standard panel (step P3).

FIGS. 7 and 8 show a possible sequence when the decade keyboard Z is switched on (step P4). This sequence can be summarized in the following terms:

On actuation of the converter button H (sensor S), all already existing car calls "ECC" are detected in the elevator control and the lamps of the associated floor buttons are extinguished. The acknowledgement lamp of the converter button H lights up (step S3). A timer switches on and the floor buttons "0" to "9" of the panel 1 (11, 12), which form the decade keyboard Z, begin to flash at a frequency of preferably 2 Hz (step S5). If the decade keyboard Z remains unactuated within a time of, for example, five seconds (step S9) or if the door closing button DT-S is pressed (step S8), then the lamp of the converter button H switches off (step S83) and the flashing of the decade keyboard Z stops (step S84). The decade keyboard Z is switched off and the panel 1 (11, 12) can again be used as a standard panel (step S86). The lamps of the floor buttons which correspond with the already registered car calls "ECC" light up again (step S85). If the decade keyboard Z is actuated after actuation of the changeover button H, then a valid car call can be input, which is stored in a central memory for calls "MCC". This central memory "MCC" is then picked up in the already registered car calls "ECC". In this manner a code can also be input by means of the decade keyboard Z. As soon as a button of the decade keyboard Z is actuated, the timer is newly started so that there is still time for actuation of further buttons of the decade keyboard. Depending on the respective case, car calls and different codes can thus be input. As soon as the door closing button DT-S is actuated or the set time of the time transmitter elapses or commands are input which are not acceptable by the system, the decade keyboard Z is switched off and the panel 1 (11, 12) may be operable again as a standard panel.

A valid car call is the call which is actually served by the elevator. This means that if the elevator serves, for example, the floors "0" to "31", the valid car calls go from "0" to "31". The car calls "32" and "33" would therefore not be valid.

The individual steps shown in the flow charts of FIGS. 6, 7 and 8 are indicated in detail in the following:

FIG. 6:

P1: State of the converter button H is read

P2: Has the converter button H been actuated?If yes, then continue with P4, otherwise continue with step P3.

P3: Panel is used as standard panel

P4: Decade keyboard Z is activated

FIGS. 7 and 8:

S1: All already existing car calls "ECC" are detected

S2: All acknowledgement lamps of the car calls "ECC" of step S1 are switched off S3: Acknowledgement lamp of the converter button H lights up S4: Timer for converter button H or decade keyboard Z starts, i.e. on actuation of the converter button for the decade keyboard a predetermined time of, for example, 5 seconds starts.

S5: The floor buttons "0" to "9" of the decade keyboard Z flash at a frequency of preferably 2 Hz S6: State of the floor buttons "0" to "9" is read S7: Has one of the floor buttons "0" to "9" been actuated?If yes "Y", then continue with step S10, otherwise "N" continue with step S8.

S8: Has the door closing button DT-S been actuated?If yes "Y", then continue with step S83, otherwise "N" continue with step S9.

S9: Has the predetermined time of the timer elapsed?If yes "Y", then continue with step S83, otherwise "N" continue with step S6.

S10: The actuated floor button in step S7 is detected in a first memory "M1"

S11: Timer restarts

S12: State of the floor buttons "0" to "9" is read

S13: Has one of the floor buttons "0" to "9" been actuated?If yes "Y", then continue with step S21, otherwise "N" continue with step S14.

S14: Has the door closing button DT-S been actuated?If yes "Y", then continue with step S16, otherwise "N" continue with step S15.

S15: Has the predetermined time of the timer elapsed?If yes "Y", then continue with step S16, otherwise "N" continue with step S12.

S16: The floor button detected in the first memory "M1" applies as call input

S17: Is the call input in step S16 valid?If yes "Y", then continue with step S18, otherwise "N" continue with step S83.

S18: Acknowledgement lamp of the floor button corresponding with the call input of step S16 lights up S19: Call input of step S16 is stored in central memory "MCC"

S20: Central memory "MCC" is detected in car calls "ECC"

S21: The actuated floor button in step S13 is detected in a second memory "M2"

S22: The combination of the actuated floor buttons which are detected in memories "M1" and "M2" applies as call input S23: Is the call input in step S22 valid?If yes "Y", then continue with step S24, otherwise "N" continue with step S27

S24: The acknowledgement lamp or lamps of the floor button or buttons corresponding with the call input in step S22 lights or light up S25: Call input in step S22 is stored in central memory "MCC"

S26: Central memory "MCC" is detected in car calls "ECC"

S27: Timer restarts

S28: State of the floor buttons "0" to "9" is read

S29: Has one of the floor buttons "0" to "9" been actuated?If yes "Y", then continue with step S32, otherwise "N" continue with step S30.

S30: Has the door closing button DT-S been actuated?If yes "Y", then continue with step S83, otherwise "N" continue with S31.

S31: Has the predetermined time of the timer elapsed?If yes "Y", then continue with step S83, otherwise "N" continue with S28.

S32: The actuated floor button in step S29 is detected in a third memory "M3"

S33: The acknowledgement lamp or lamps of the floor button or buttons corresponding with the call input in step S32 switches or switch off S34: Central memory "MCC" is cancelled S35: Does the combination of actuated floor buttons which are detected in the memories "M1" to "M3" correspond with a part of the code "RC" or a part of the code "SFC"?If yes "Y", then continue with step S36, otherwise "N" continue with step S83.

S36: Timer restarts

S37: State of the floor buttons "0" to "9" is read

S38: Has one of the floor buttons "0" to "9" been actuated?If yes "Y", then continue with step S41, otherwise "N" continue with step S39.

S39: Has the door closing button DT-S been actuated?If yes "Y", then continue with step S83, otherwise "N" continue with step S40.

S40: Has the predetermined time of the timer elapsed?If yes "Y", then continue with step S83, otherwise "N" continue with step S37.

S41: The actuated floor button in step S38 is detected in a fourth memory "M4"

S42: Does the combination of actuated floor buttons which are detected in the memories "M1" to "M4" correspond with the code for restricted control "RC"?If yes "Y", then continue with step S61, otherwise "N" continue with step S43.

S43: Does the combination of the actuated floor buttons which are detected in the memories "M1" to "M4" correspond with a part of the code "RC" or a part of the code "SFC"?If yes "Y", then continue with step S44, otherwise "N" continue with step S83.

S44: Timer restarts

S45: State of the floor buttons "0" to "9" is read

S46: Has one of the floor buttons "0" to "9" been actuated?If yes "Y", then continue with step S49, otherwise "N" continue with step S47.

S47: Has the door closing button DT-S been actuated?If yes "Y", then continue with step S83, otherwise "N" continue with step S48.

S48: Has the predetermined time of the timer elapsed?If yes "Y", then continue with step S83, otherwise "N" continue with step S45.

S49: The actuated floor button in step S46 is detected in a fifth memory "M5"

S50: Does the combination of the actuated floor buttons which are detected in the memories "M1" to "M5" correspond with a part of the code "RC" or a part of the code "SFC"?If yes "Y", then continue with step S51, otherwise "N" continue with step S83.

S51: Timer restarts

S52: State of the floor buttons "0" to "9" is read

S53: Has one of the floor buttons "0" to "9" been actuated?If yes "Y", then continue with step S56, otherwise "N" continue with step S54.

S54: Has the door closing button DT-S been actuated?If yes "Y", then continue with step S83, otherwise "N" continue with S55.

S55: Has the set time of the timer elapsed?If yes "Y", then continue with step S83, otherwise "N" continue with step S52.

S56: The actuated floor button in step S53 is detected in a sixth memory "M6"

S57: Does the combination of the actuated floor buttons which are detected in the memories "M1" to "M6" correspond with a part of the code "RC" or a part of the code "SFC"?If yes "Y", then continue with step S58, otherwise "N" continue with step S83.

S58: Association of the code with a function (for example, special function)

S59: Function is activated (for example, special function)

S60: Function is indicated on display device 4

S61: Timer restarts

S62: State of the floor buttons "0" to "9" is read

S63: Has one of the floor buttons "0" to "9" been actuated?If yes "Y", then continue with step S71, otherwise "N" continue with step S64.

S64: Has the door closing button DT-S been actuated?If yes "Y", then continue with step S83, otherwise "N" continue with step S65.

S65: Has the set time of the timer elapsed?If yes "Y", then continue with step S83, otherwise "N" continue with step S62.

S66: The floor button detected in the fifth memory "M5" applies as call input

S67: Is the call input of step S66 valid?If yes "Y", then continue with step S68, otherwise "N" continue with step S83.

S68: Acknowledgement lamp of the floor button corresponding with the call input of step S66 lights up S69: Call input of step S66 is stored in the central memory "MCC"

S70: Central memory "MCC" is detected in car calls "ECC"

S71: The actuated floor button in step S63 is detected in a fifth memory "M5"

S72: Timer restarts

S73: State of the floor buttons "0" to "9" is read

S74: Has one of the floor buttons "0" to "9" been actuated?If yes "Y", then continue with step S77, otherwise "N" continue with step S75.

S75: Has the door closing button DT-S been actuated?If yes "Y", then continue with step S66, otherwise "N" continue with step S76.

S76: Has the set time of the timer elapsed?If yes "Y", then continue with step S66, otherwise "N" continue with step S73.

S77: The actuated floor button in step S74 is detected in a sixth memory "M6"

S78: The combination of the actuated floor buttons which are detected in memories "M5" and "M6" applies as call input S79: Is the call input of step S78 valid?If yes "Y", then continue with step S80, otherwise "N" continue with step S83.

S80: The acknowledgement lamp or lamps of the floor button or buttons corresponding with the call input of step S78 lights or light up S81: Call input of step S78 is stored in the central memory "MCC"

S82: Central memory "MCC" is detected in the car calls "ECC"

S83: Acknowledgement lamp of the converter button H switches off

S84: Acknowledgement lamps of the floor buttons "0" to "9" switch off

S85: Acknowledgement lamps of the car call "ECC" light up

S86: The panel 1 (11, 12) is used as a standard panel.

The panel 1 (11, 12) operates in a similar manner when used to generate hall calls. The converter button H and the sensor S are converter means for changing the operation of the panel 1 (11, 12) from the normal mode of operation to the converted mode of operation described above.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A panel apparatus for generating floor calls in an elevator installation comprising:

a panel having a front face and adapted to be mounted on one of an elevator car wall and a building hallway wall;

a predetermined number of floor buttons mounted on said panel front face, said floor buttons each being actuatable either individually or in combination for generating a floor call for travel to an associated destination floor for each destination floor of the elevator installation in a normal mode of operation of the panel apparatus; and a converter means mounted on said panel front face and being actuatable for converting the panel apparatus from said normal mode of operation to a converted mode of operation whereby all of the destination floors are also selectable by actuation of a group of said floor buttons being less than all of said floor buttons.

2. The panel apparatus according to claim 1 wherein said group of said floor buttons forms a decade keyboard.

3. The panel apparatus according to claim 1 wherein said converter means includes a converter button being actuatable for converting the panel apparatus.

4. The panel apparatus according to claim 1 wherein said converter means includes a sensor being responsive to a signal for converting the panel apparatus.

5. The panel apparatus according to claim 1 wherein said panel is adapted to be mounted in an elevator car and said floor buttons generate said floor calls as car calls.

6. The panel apparatus according to claim 1 wherein said panel is adapted to be mounted in a building hallway and said floor buttons generate said floor calls as hall calls.

7. A method of operating a panel apparatus in an elevator installation comprising the steps of:

a. providing a predetermined number of floor buttons;

b. actuating each of the floor buttons individually or in combination in a normal mode of operation to generate floor calls to associated ones of all destination floors of a building served by an elevator installation;

c. providing converter means;

d. actuating the converter means to switch from the normal mode of operation to a converted mode of operation; and e. actuating a group of the floor buttons being less than all of the floor buttons in the converted mode of operation to generate the floor calls for all of the destination floors.

8. The method according to claim 7 including forming the group of the floor buttons as a decade keyboard.

9. The method according to claim 7 wherein said step c. is performed by providing a converter button actuatable by a passenger.

10. The method according to claim 7 wherein said step c. is performed by providing a sensor responsive to a signal generated by a passenger.

11. The method according to claim 7 including a step of actuating the group of floor buttons in the converted mode of operation to enter a code representing at least one of access identification and a special function.

12. The method according to claim 7 including a step of providing a door closing button and actuating the door closing button in the converted mode of operation to generate an enter command.

13. The method according to claim 12 including a step of switching from the converted mode of operation to the normal mode of operation when the door closing button is actuated.

14. The method according to claim 7 including a step of switching from the converted mode of operation to the normal mode of operation when said step e. has not been performed within a predetermined time for one of the destination floors.

15. The method according to claim 7 including a step of flashing the floor buttons of the group during the converted mode of operation.

16. A panel apparatus for generating floor calls in an elevator installation comprising:

a panel having a front face and adapted to be mounted on one of an elevator car wall and a building hallway wall;

a predetermined number of floor buttons mounted on said panel front face, said floor buttons each being actuatable either individually or in combination for generating a floor call for travel to an associated destination floor for each destination floor of the elevator installation in a normal mode of operation of the panel apparatus; and a converter means mounted on said panel front face and being actuatable for converting the panel apparatus from said normal mode of operation to a converted mode of operation whereby all of the destination floors are also selectable by actuation of a group of said floor buttons being less than all of said floor buttons, said group of said floor buttons being positioned in a lower area of said front face and being accessible to a person seated on a wheelchair when said panel is mounted on one of the elevator car wall and the building hallway wall.

17. The panel apparatus according to claim 16 wherein said group of said floor buttons forms a decade keyboard.

18. The panel apparatus according to claim 16 wherein said converter means includes a converter button being actuatable for converting the panel apparatus and being positioned in said lower area of said front face.

19. The panel apparatus according to claim 16 wherein said panel is adapted to be mounted in an elevator car and said floor buttons generate said floor calls as car calls.

20. The panel apparatus according to claim 16 wherein said panel is adapted to be mounted in a building hallway and said floor buttons generate said floor calls as hail calls.

* * * * *